US007609996B2

(12) United States Patent
Yamaguchi

(10) Patent No.: US 7,609,996 B2
(45) Date of Patent: Oct. 27, 2009

(54) IMAGE FORMING APPARATUS HAVING A LOCKING MEMBER LOCKING AN IMAGE FORMING UNIT ATTACHED THERETO

(75) Inventor: Yoshimasu Yamaguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 11/931,712

(22) Filed: Oct. 31, 2007

(65) Prior Publication Data

US 2008/0107445 A1 May 8, 2008

(30) Foreign Application Priority Data

Nov. 7, 2006 (JP) ..... 2006-301455

(51) Int. Cl.
*G03G 15/00* (2006.01)

(52) U.S. Cl. ..... 399/111

(58) Field of Classification Search ..... 399/111, 399/119, 107, 110, 24, 25
See application file for complete search history.

(56) References Cited

U.S. PATENT DOCUMENTS

| | | | | |
|---|---|---|---|---|
| 5,508,795 | A * | 4/1996 | Kikuchi | 399/27 |
| 5,828,929 | A | 10/1998 | Watanabe et al. | 399/111 |
| 6,453,135 | B1 * | 9/2002 | Sameshima et al. | 399/110 |
| 7,187,886 | B2 | 3/2007 | Kawasumi | 399/111 |
| 2006/0045566 | A1 * | 3/2006 | Kanno et al. | 399/111 |
| 2006/0067733 | A1 * | 3/2006 | Kawasumi | 399/111 |
| 2006/0127129 | A1 * | 6/2006 | Jung et al. | 399/111 |
| 2006/0159486 | A1 * | 7/2006 | Kweon | 399/110 |

FOREIGN PATENT DOCUMENTS

| | | | |
|---|---|---|---|
| JP | 11-174940 | | 7/1999 |
| JP | 2000181329 | A * | 6/2000 |
| JP | 2006-98492 | | 4/2006 |

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes an image forming unit which has an image bearing member and which is detachably attachable to the image forming apparatus, a guide section for guiding an insertion operation of the image forming unit, a movable locking member for locking the attached image forming unit from moving along a guide direction, a moving member which moves when the moving member comes into contact with the image forming unit which is guided and inserted by the guide section, and a locking member moving portion which starts moving the locking member when a moving amount of the moving member becomes great.

13 Claims, 14 Drawing Sheets

PRIOR ART

IMAGE FORMING APPARATUS HAVING A LOCKING MEMBER LOCKING AN IMAGE FORMING UNIT ATTACHED THERETO

BACKGROUND OF THE INVENTION

1. Field of the Invention

The present invention relates to an image forming apparatus which forms an image using an image forming unit or a process cartridge which can be attached to and detached from the image forming apparatus.

2. Description of Related Art

A conventional image forming apparatus using an electrophotographic image forming process employs a process cartridge system in which a photosensitive drum and process means applied to it are integrally formed into a cartridge, and the cartridge (image forming unit) is detachably attachable to an image forming apparatus main body. According to this process cartridge system, a user can perform the maintenance operation of the apparatus without asking a service man to do it and thus, the operability can remarkably be enhanced. Thus, this process cartridge system is widely used in image forming apparatuses.

When such a process cartridge is attached to the image forming apparatus main body, it is necessary to precisely maintain a positional relation between the process cartridge and the image forming apparatus main body while keeping the appropriate operating feeling when the attaching operation is completed.

As a configuration for positioning the process cartridge to the image forming apparatus and holding the same, one using a wire spring as described in Japanese Patent Application Laid-open No. 11-174940 is widely used. According to this configuration, projections are provided on both sides of the process cartridge in its longitudinal direction, and the projections are engaged with and positioned to U-grooves formed in the cartridge attaching portions of the apparatus main body when the process cartridge is inserted along the guide section of the apparatus main body. When the cartridge projections are engaged with the U-grooves, the wire spring provided in the U-groove clamps the cartridge projection, thereby fixing the cartridge projection.

According to the configuration for fixing the cartridge projection using the wire spring, the clamping force of the wire spring with respect to the process cartridge projection becomes a resistance when the cartridge is inserted. Further, the projection and the wire spring are always in contact with each other until the projection abuts against a bottom of the U-groove. Thus, this resistance acts until the process cartridge is positioned at a normal position. As a result, when the insertion becomes insufficient, the cartridge may float or ride, which prevents the cartridge from being positioned at the normal position in some cases.

As a method for solving this problem, there is proposed a configuration using a toggle latch as positioning and fixing configurations of the process cartridge as described in Japanese Patent Application Laid-open No. 2006-98492.

FIG. 14 is a diagram for describing positioning and fixing configurations of the process cartridge according to the Japanese Patent Application Laid-open No. 2006-98492. In FIG. 14, a toggle arm 90 can turn between two positions, i.e., a first position (a position where the cartridge is opened) shown with a solid line, and a second position (a position where the cartridge is fixed) which is turned from the first position in the direction of arrow Y and which is shown with a broken line. The toggle arm 90 can turn between the first position and the second position by the turning shaft C.

As shown in FIG. 14, the toggle arm 90 is provided with an extension spring 91. The extension spring 91 is engaged with a spring fulcrum D provided on a side plate 92, and a spring hook 93 provided on the toggle arm 90. When the toggle arm 90 is in the first position shown with the solid line in FIG. 14, the spring hook 93 is located on one side (upper side in FIG. 14) of a line segment C-D connecting the spring fulcrum D on the side plate and the turning shaft C. When the toggle arm 90 is located in the second position shown with the broken line, the spring hook 93 is located on the other side (lower side in FIG. 14) of the line segment C-D.

If the above configuration is employed, when the toggle arm 90 is in the first position shown with the solid line, a moment in the X direction acts due to the extension spring 91. Therefore, no other external force acts, and the toggle arm 90 is held in the first position. When the cartridge is inserted and a projection 94 provided on the cartridge is engaged with a U-groove 95 formed in the apparatus main body from this state, the projection 94 pushes an engaging section 96 of the toggle arm 90. With this, a moment in the direction of the arrow Y in FIG. 14 is given to the toggle arm 90, and the toggle arm 90 turns in the direction of the arrow Y against the extension spring 91. When the spring hook 93 moves to a position lower than an extension of the line segment C-D, a moment generated by the extension spring 91 is changed from the X direction to the Y direction, and when no other external force acts, it is held in the second position.

With this, when the cartridge is positioned, the resistance of the spring does not act until the positioning operation is completed, and the operability is remarkably enhanced. After the toggle arm 90 moves to the second position, the projection 94 is pushed against the U-groove 95 by a biasing force of the extension spring 91. Thus, the cartridge is reliably fixed at the positioned location.

In Japanese Patent Application No. 2006-98492, a spring force of the toggle arm 90 presses the process cartridge to prevent the process cartridge from floating, and this leads to stabilization of an image quality. Thus, a spring 91 used for the toggle arm 90 is set to be strong.

However, if the spring 91 is made strong and the movement of the toggle arm 90 to the second position is delayed, the rotation force produced by the spring force becomes a maximum at both ends of turning motion of the toggle arm 90 when the cartridge is attached or detached, and this provides a heavy feeling when the process cartridge is attached or detached. If this operating feeling is too heavy, a user may falsely believe that the process cartridge has been successfully attached even through the attaching operation has not yet been completed.

Therefore, if a dead point near a neutral point of the extension spring 91 is set early, such a heavy operating feeling can be lightened. That is, if it is pushed a little, the toggle arm 90, which is a fixing member is immediately operated.

However, the above setting causes the following problem. That is, the toggle mechanism is operated even if a user accidentally moves the toggle arm 90. If it is once operated, a locked state is established and thus, the guide portion of the housing is occluded. That is, the toggle arm 90 moves faster than the process cartridge, and this prevents the process cartridge from being inserting.

Especially when the process cartridge is large and can handle A3 paper, a user can not sufficiently visually check both positions in the longitudinal direction and thus, the toggle arm 90 moves accidentally every so often. That is, a user is forced to roughly guide one side and then insert the other side in the longitudinal direction, and attach them to the pair of U-grooves 95 in a straight manner while paying attention to keep the cartridge parallel as precisely as possible. At that time, the toggle arm 90, which is a projection located near an inlet of the U-groove 95, is easily caught on an end of the thin and long process cartridge in its longitudinal direction, since it is designed such that it is moved lightly because emphasis is placed on producing a light operating feeling, thus, there is a problem that it is easily operated.

If the toggle arm 90 is operated accidentally, it is required to return the toggle arm 90 to the first position again before the process cartridge is inserted and thus, there is a problem that usability deteriorates.

SUMMARY OF THE INVENTION

The present invention provides an image forming apparatus which reduces a load when an image forming unit is inserted and which prevents a fixing member from accidentally moving.

The invention also provides an image forming apparatus comprising: an image forming unit which has an image bearing member and which is detachably attachable to the image forming apparatus; a guide section for guiding an insertion operation of the image forming unit; a movable locking member for locking the attached image forming unit; a moving member which start to move when the moving member comes into contact with the image forming unit which is inserted along the guide section; and a locking member moving portion which is in the locking member and receives displacement force when the moving member moves a specified distance; wherein the displacement force moves the locking member to a position to lock the attached image forming unit.

Further objects of the invention will be apparent from the following description.

DETAILED DESCRIPTION OF THE PREFERRED EMBODIMENTS

Next, an image forming apparatus according to an embodiment of the present invention will be described concretely with reference to the drawings.

First Embodiment

{Entire Structure of Image Forming Apparatus}

Figure 4A:
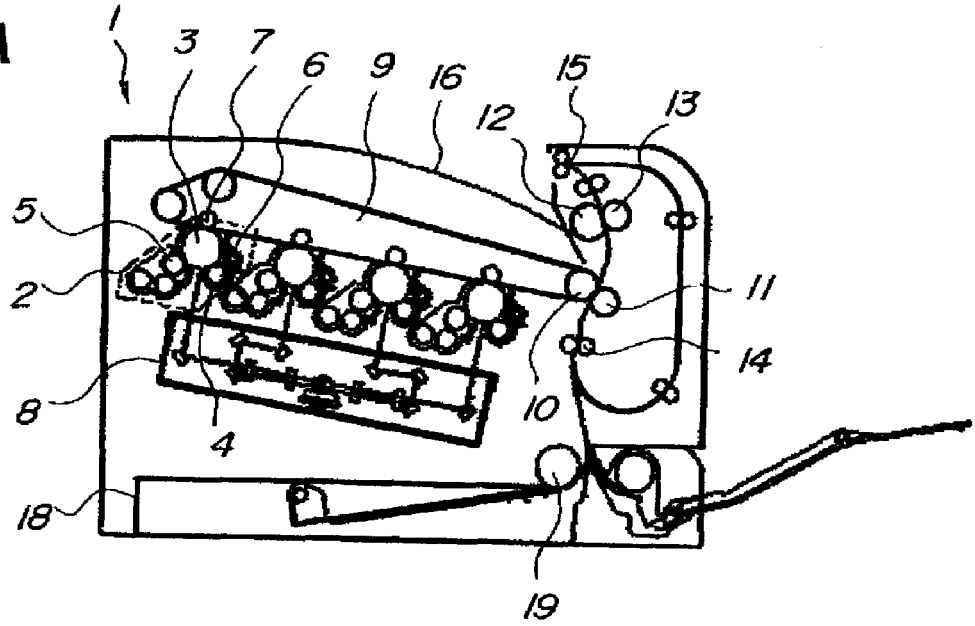
FIGS. 4A and 4B are explanatory sectional views showing the entire structure of an image forming apparatus.
Figure 4B:
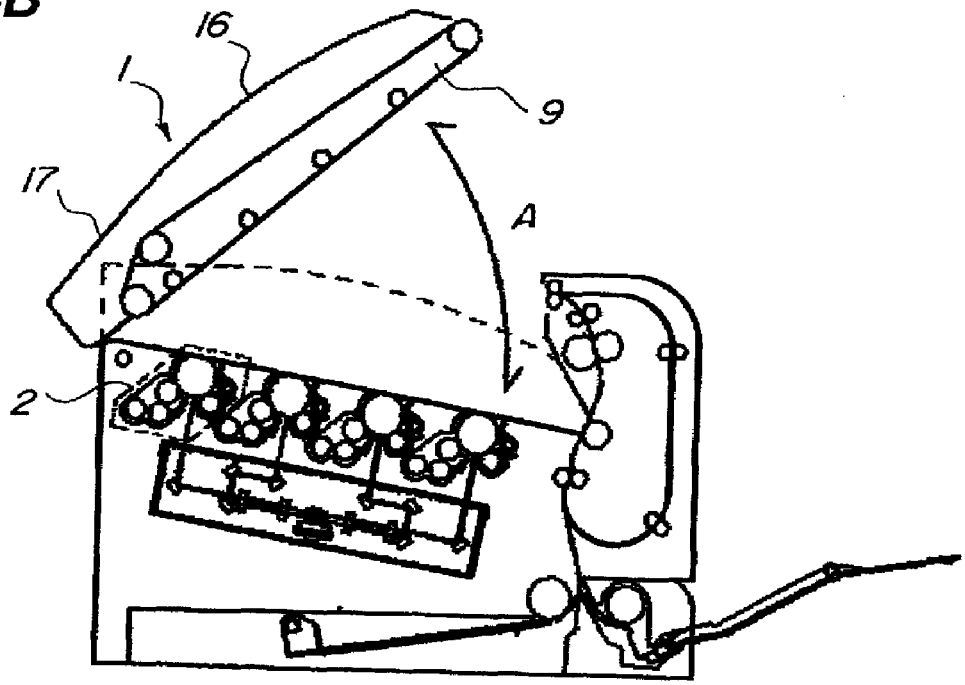

FIGS. 4A and 4B are explanatory sectional views showing the entire structure of a full color image forming apparatus (full color printer) according to a first embodiment having an in-line intermediate transfer belt (intermediate transfer means) employing an electrophotographic system.

First, the entire structure of the image forming apparatus will be described referring to FIG. 4A. The image forming apparatus 1 of the first embodiment includes four process cartridges 2 (cartridges, hereinafter) which are image forming units disposed on substantially one straight line at constant distances from one another. These four cartridges 2 form yellow (Y), magenta (M), cyan (C) and black (K) images, respectively. Each cartridge 2 is provided at its central portion with a drum shaped electrophotographic photosensitive member (photosensitive drum, hereinafter) 3 as an image bearing member. A primary charger 4 as primary charging means, a developing device 5 as developing means, and a drum cleaner 6 as cleaning means are disposed around the photosensitive drum 3, and they constitute one cartridge.

The primary charger 4 uniformly charges a surface of the photosensitive drum 3 with a predetermined negative potential by a charging bias applied from a charging bias power supply (not shown). The developing device 5 includes toner, and adheres toner of each color to each electrostatic latent image formed on each photosensitive drum 3 by laser light to develop (form a visible image) as a toner image. The drum cleaner 6 includes a cleaning blade for removing, from the photosensitive drum 3, toner which remains at the time of primary transfer.

A transfer roller 7 as primary transfer means is disposed at a position opposed to the photosensitive drum 3, and an exposing device 8 is disposed below a location between the primary charger 4 and the developing device 5. The transfer roller 7 is disposed in the transfer belt unit 9 having a belt-like transfer material, and the transfer roller 7 is disposed such that a force is applied to the photosensitive drum 3. The exposing device 8 emits light in correspondence with a time-series, electrical-digital-picture-element signal of given image information, exposes each photosensitive drum 3 to the emitted light, and forms an electrostatic latent image of each color in accordance with image information on a surface of each photosensitive drum 3, which is charged by each primary charger 4.

The transfer belt unit 9 includes a drive roller 10 which also functions as a secondary transfer counter roller. The drive roller 10 is disposed such that it is opposed to a secondary transfer roller 11. A fixing device having a fixing roller 12 and a pressure roller 13 is disposed with a vertical pass structure downstream in a conveying direction of a recording material of the secondary transfer roller 11.

The recording material, which is set in a sheet cassette 18, is supplied one sheet by one sheet by a sheet roller 19, and delivered to nips of the secondary transfer roller 11 and the drive roller 10 by a pair of resist rollers 14, and transfers a toner image. The recording material on which the toner image is transferred is delivered to a fixing device comprising a pressure roller 13 and a fixing roller 12, and the toner image is fixed, and the recording material is discharged into a discharger tray 16 by a discharger roller 15.

The cartridge 2 and the transfer belt unit 9 have a lifespan shorter than that of the image forming apparatus 2 due to their properties, and it is necessary to replace the cartridge 2 and the transfer belt unit 9 with new ones before termination of the life of the apparatus main body. Hence, a unit having the discharger tray 16 and the transfer belt unit 9 is constituted as an upper door unit 17 such that the unit can open and close with respect to the image forming apparatus main body so that the cartridge 2 and the transfer belt unit 9 can easily be replaced by new ones as shown in FIG. 4B.

With this structure, if the upper door unit 17 is opened toward the arrow (direction A in FIG. 4B) above the main body, both the cartridge 2 and transfer belt unit 9 can freely be attached and detached, and the maintenance operation is facilitated. That is, the cartridge 2 is attached to and detached from the apparatus main body in a direction perpendicular to an axis of the photosensitive drum 3.

{Attaching and Detaching Structure of Cartridge}

Figure 5:
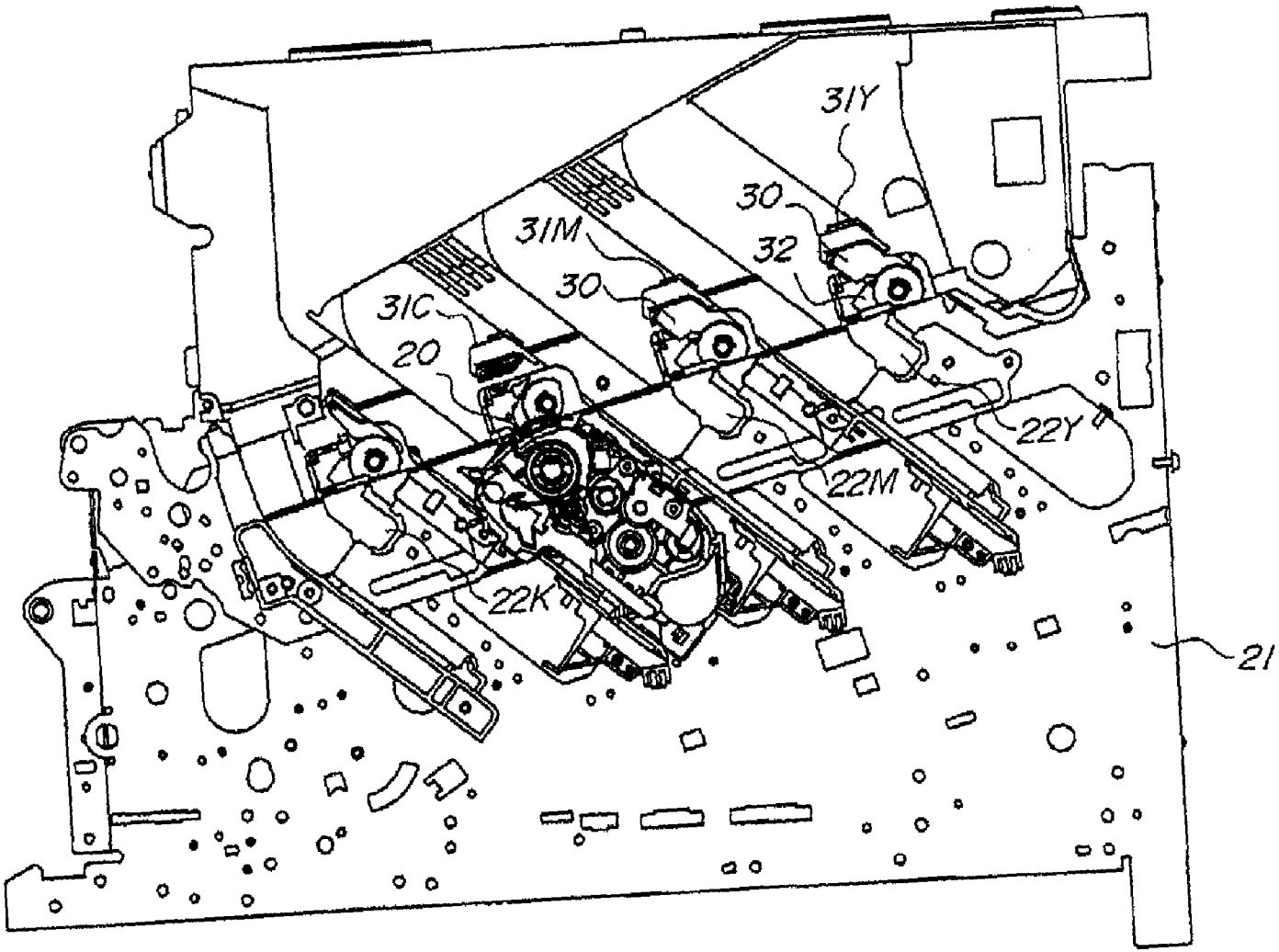
FIG. 5 is an explanatory side sectional view of a cartridge attaching section of an image forming apparatus.
Figure 6:
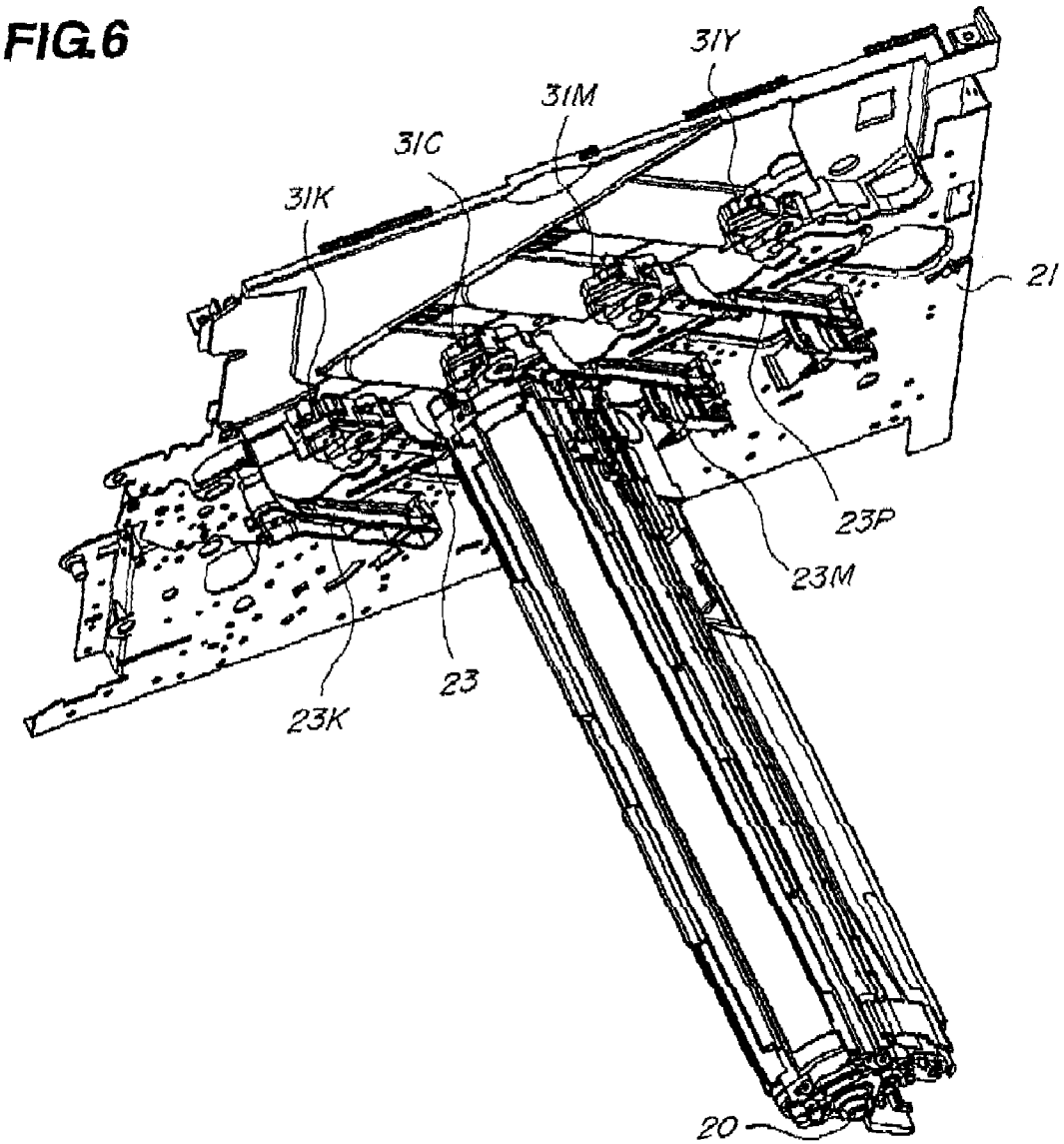
FIG. 6 is an explanatory perspective view of the cartridge attaching section according to the first embodiment.

Next, a structure of detachably attaching the cartridge 2 to the image forming apparatus main body will be described. FIG. 5 is an explanatory side sectional view of the cartridge attaching section of the image forming apparatus. FIG. 6 is an explanatory perspective view of the cartridge attaching section. FIG. 6 shows a side plate of only one side in the longitudinal direction of the cartridge.

As shown in FIGS. 5 and 6, the cartridge 2 is provided with a cylindrical projection 20 which functions as positioning means. The projection 20 projects both sides on an extension of a rotation axis of the photosensitive drum 3. The image forming apparatus 2 has a cartridge attaching section. The attaching section has a space for inserting the cartridge 2 into the apparatus main body. Side plates 21 are provided on both sides in the longitudinal direction of the cartridge. The left and right side plates 21 with U-grooves 22 (22Y, 22M, 22C and 22K) as positioning sections, and the circular projection 20 is precisely received in a predetermined position. Guide members 23 (23Y, 23M, 23C and 23K) as cartridge attaching guide means are mounted on the cartridge attaching section.

When the cartridge 2 is to be attached, a lower surface of the cartridge 2 is diagonally downwardly inserted along the guide member 23, and the projection 20 is engaged with the U-groove 22. The engaged projection 20 abuts against a lower end of the U-groove 22, thereby positioning the cartridge 2. The U-groove 22 also functions as a guide section for guiding the projection 20.

In this embodiment, there is provided locking means which positions the cartridge 2 with respect to the image forming apparatus main body, and locks the cartridge to prevent the cartridge from moving in a direction opposite from a direction in which the cartridge 2 is inserted. In this embodiment, a toggle latch mechanism is used as the locking means.

Four toggle arms 30, which are locking members, as the main body of the toggle latch, are provided in correspondence with the cartridge inserting openings, and the pair of left and right side plates 21 are provided with the toggle arms 30. The toggle arms 30 are moved in association with the inserting motion of the cartridge 2, and the projection 20 of the inserted cartridge 2 is pressed and fixed.

The toggle arm 30 is attached at a position where the toggle arm 30 can press the projection 20 of the cartridge 2 to be inserted. Protection covers 31 (31Y, 31M, 31C and 31K) are provided near a location above the toggle arm 30 to cover the location above the toggle arm 30 so that a user does not accidentally touch the toggle arm 30 to operate the toggle arm 30 erroneously. Here, the term "above" refers to the opposite side from the insertion direction of the cartridge 2 with respect to the toggle arm. Since the above portion of the toggle arm 30 is covered with the protection cover 31, a user does not touch the toggle arm 30 accidentally, and the toggle arm 30 is not locked by an erroneous operation.

{Structure of Locking Means}

Next, this embodiment is characterized by the toggle latch, which is locking means for fixing the process cartridge. This structure will be described.

Figure 1A:
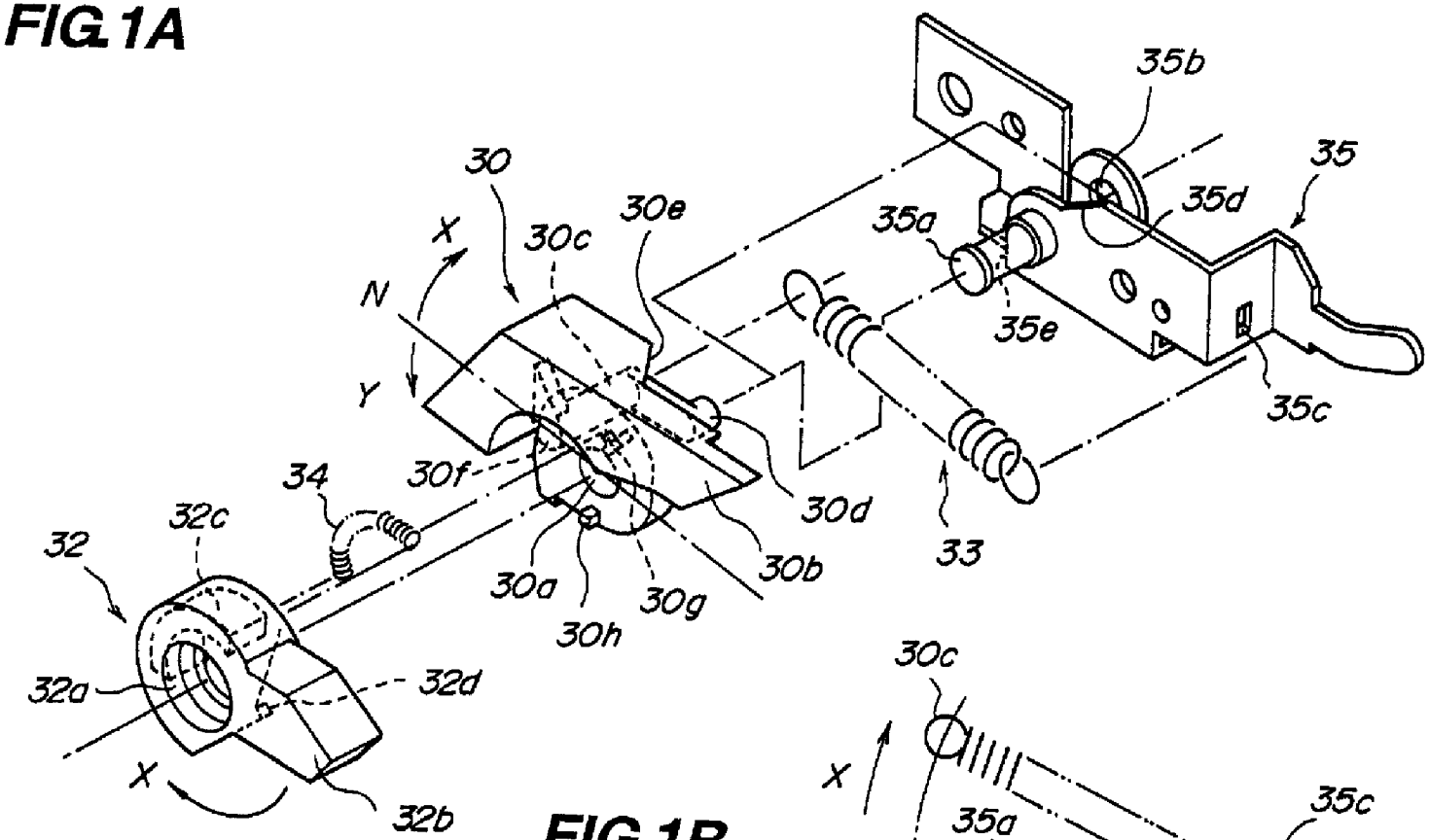
FIGS. 1A and 1B are explanatory exploded perspective views of members of a toggle latch according to a first embodiment.

FIG. 1A is an explanatory exploded perspective view of members of the locking means of the embodiment. The locking means of the embodiment includes a toggle arm 30, which is locking member for locking the cartridge projection 20 and preventing the projecting 20 from moving, a toggle spring 33 which is a biasing member for applying a biasing force to the toggle arm 30, an input lever 32 which is a moving member for abutting against a portion of the cartridge and moving and operating the toggle arm 30, and a compression spring 34 which is a biasing member for returning the input lever 32.

The locking means of the embodiment operates the toggle arm 30 by rotating the input lever 32. At that time, the locking means does not operate the toggle arm 30 until the input lever 32 rotates by a certain angle, and if the input lever 32 rotates more than the certain angle, the toggle arm 30 is operated. That is, even if the projection of the cartridge 2 pushes the input lever 32 by a predetermined amount, it is not locked by the toggle arm 30. The structure will be described concretely. The input lever 32 has a moving width through which the input lever 32 can move the toggle arm 30 in a state where it is in the receded position, and if the input lever 32 moves beyond the moving width, the toggle arm 30 is moved from the receded position to the locking position.

The toggle arm 30 can move to a first position (locking position) where the cartridge pushes and locks the projection 20 which is inserted into the attaching section and engaged with the U-groove 22, and a second position (receded position) which is receded from a moving path of the projection 20 when the cartridge is taken out from the attaching section. The toggle arm 30 has a shaft hole 30*a* into which a shaft portion 35*a* which is mounted on the mounting plate 35 by swaging. The toggle arm 30 is provided on one side with an arm portion 30*b* and on the other side with a spring retaining portion 30*c* with respect to the shaft hole 30*a*. The arm portion 30*b* presses the cartridge projection 20 toward one side around the shaft hole 30*a*. The mounting plate 35 is mounted on a side plate 21 by a screw or the like. The toggle arm 30 has an arm portion which is continuous with the spring retaining portion 30*c*, and the arm portion is formed at its tip end with a shaft portion 30*d*.

The shaft portion 35*a* of the mounting plate 35 is fitted into the shaft hole 30*a* of the toggle arm 30, and the shaft portion 30*d* is fitted into the shaft hole 35*b* of the mounting plate 35. With this, the toggle arm 30 is turnably mounted on the mounting plate 35. In this state, one end of the toggle spring 33 is retained by the spring retaining portion 35*c*, and the other end is retained by the spring retaining portion 30*c* of the toggle arm 30.

Figure 1B:
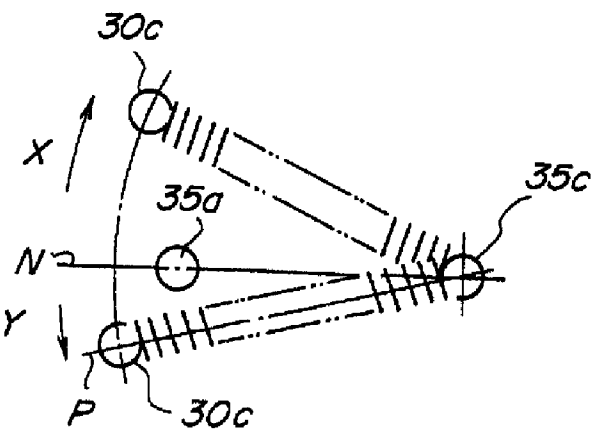

The toggle spring 33 comprises an extension spring. The toggle spring 33 applies a force to the toggle arm 30 toward the locking position or the receded position. That is, as shown in FIG. 1(*b*), when the spring retaining portion 30*c* to which one end of the toggle spring 33 is retained is located closer to X side than a line segment N which connects the spring retaining portion 35*c* which is the other end of the spring and the shaft portion 35*a* which is a turning center of the toggle arm 30, the toggle spring 33 applies a force to the toggle arm 30 in the direction of the arrow X. That is, the toggle spring 33 applies a force to the toggle arm 30 toward the locking position. If a first retaining portion 30*e* of the toggle arm 30 is retained to the first stopper portion 35*d*, further rotation is prevented and the toggle arm 30 is locked.

When the spring retaining portion 30*c* is located closer to the Y side than the line segment, on the other hand, a force is applied to the toggle arm 30 in the direction of the arrow Y. That is, the toggle spring 33 applies a force to the toggle arm 30 toward the receded position. At that time, if the second retaining portion 30*f* of the toggle arm 30 is retained to the second stopper portion 35*e*, further rotation is prevented and the toggle arm 30 is locked.

A force is applied to the toggle arm 30 such that the toggle arm 30 is located in one of the locking position and the receded position with respect to a neutral point (a point at which a line segment P connecting the spring retaining portion 35*c* and the spring retaining portion 30*c* with each other and a line segment N connecting the spring retaining portion 35*c* and the shaft portion 35*a* with each other match with each other). That is, the toggle arm 30 is constituted as a so-called toggle mechanism.

Like the toggle arm 30, the input lever 32 also has a shaft hole 32*a* into which the shaft portion 35*a* of the mounting plate 35 can be fitted, and a lever portion 32*b* projects from the input lever 32. Thus, after the toggle arm 30 is mounted on the shaft portion 35*a*, the shaft portion 35*a* is fitted into the shaft hole 32*a*, and the input lever 32 is mounted such that the input lever 32 can turn around the same shaft as that of the toggle arm 30. At that time, the compression spring 34 is inserted into a recess 32*c* of the input lever 32, one end of the compression spring 34 is abutted against an end of the semicircular recess 32*c*, and the other end is retained to a retaining portion 30*g* of the toggle arm 30. A force is always applied to the input lever 32 in the direction of the arrow Y by the biasing force of the compression spring 34. With this, when the input lever 32 does not receives a force from outside, a force is applied such that the lever portion 32*b* is abutted against a lower surface of the arm portion 30*b* of the toggle arm 30. In this state, the input lever 32 is in the initial position. The initial position is a position where the cartridge and the input lever 32 are not in contact with each other.

A retaining projection 32*d* is formed at a predetermined position of the input lever 32 on its side opposed to the toggle arm 30. A projection 30*h* is formed on the toggle arm 30 on its side opposed to the input lever 32. The retaining projection 32*d* can be retained to the projection 30*h*. The retaining projection 32*d* and the projection 30*h* constitute a locking member moving portion for transmitting a driving force(displacement force) to the toggle arm 30 from the input lever 32.

The retaining projection 32*d* of the input lever 32 and the projection 30*h* of the toggle arm 30 have such a positional relation that when the input lever 32 rotates from the initial position in the direction of the arrow X by a predetermined amount, the retaining projection 32*d* abuts against the projection 30*h* and is retained thereto. Thus, the input lever 32 can rotate from the initial position without acting on the toggle arm 30 until the retaining projection 32*d* abuts against the projection 30*h*.

That is, if the lever portion 32*b* located at the initial position is pushed in the direction of the arrow X, the input lever 32 rotates against the biasing force of the compression spring 34. At that time, the rotation of the input lever 32 does not act on the toggle arm 30 until the retaining projection 32*d* abuts against the projection 30*h*. In this state, if the pressure acting on the lever portion 32*b* is eliminated, the input lever 32 is returned to the initial position by the biasing force of the compression spring 34.

If the lever portion 32*b* is pressed in the direction of the arrow X after the retaining projection 32*d* abuts against the projection 30*h*, the toggle arm 30 rotates in the X direction by the rotation of the input lever 32. Then, if the toggle arm 30 rotates in the X direction beyond the neutral point, the toggle latch acts and the toggle arm 30, which is in the receded position, rotates to the locking position at a dash.

{Attaching Operation of Cartridge and Operation of Locking Means}

Figure 2:
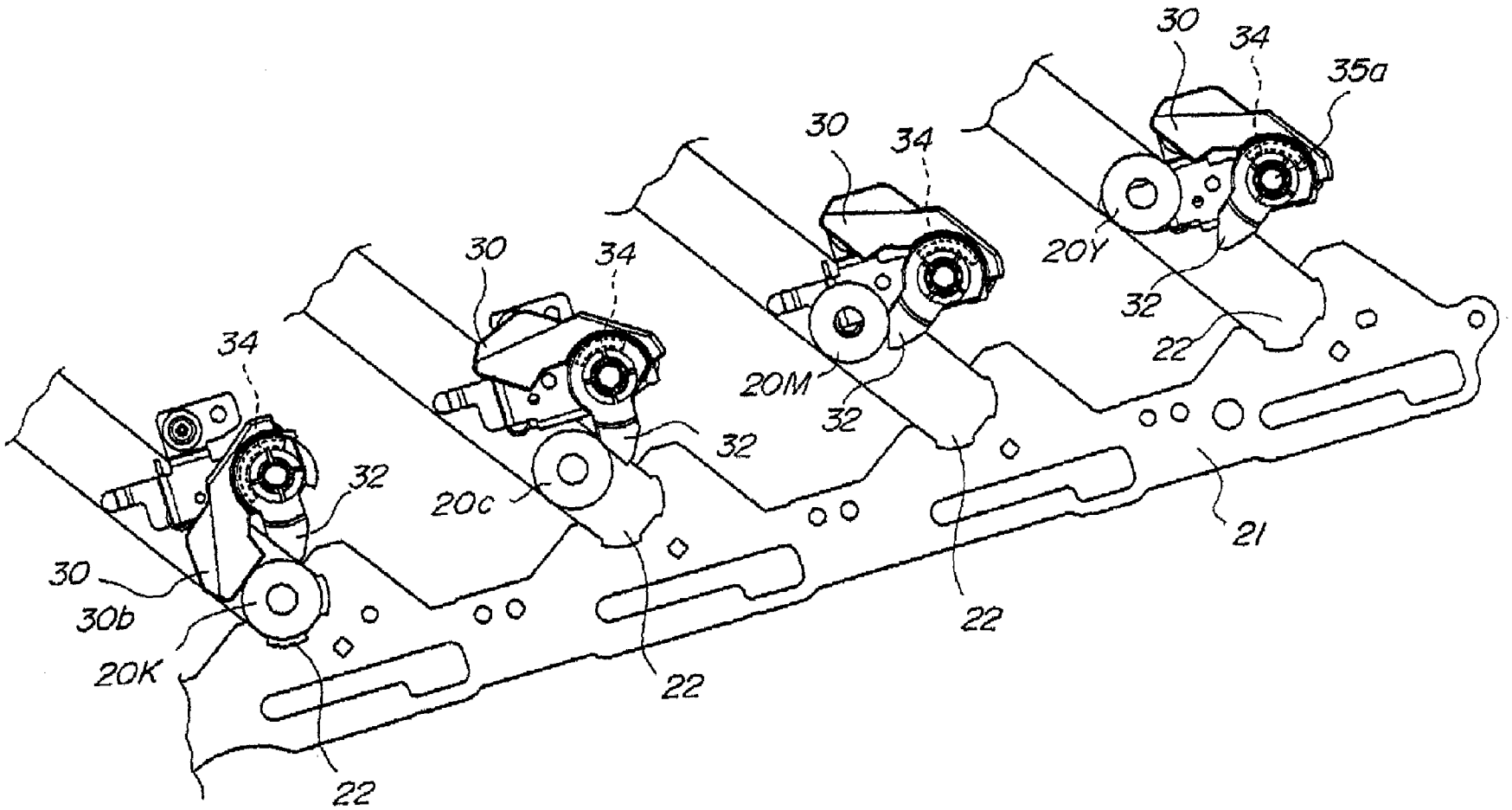
FIG. 2 is an explanatory diagram showing a position of a cartridge projection and operations of an input lever and a toggle arm.
Figure 3:
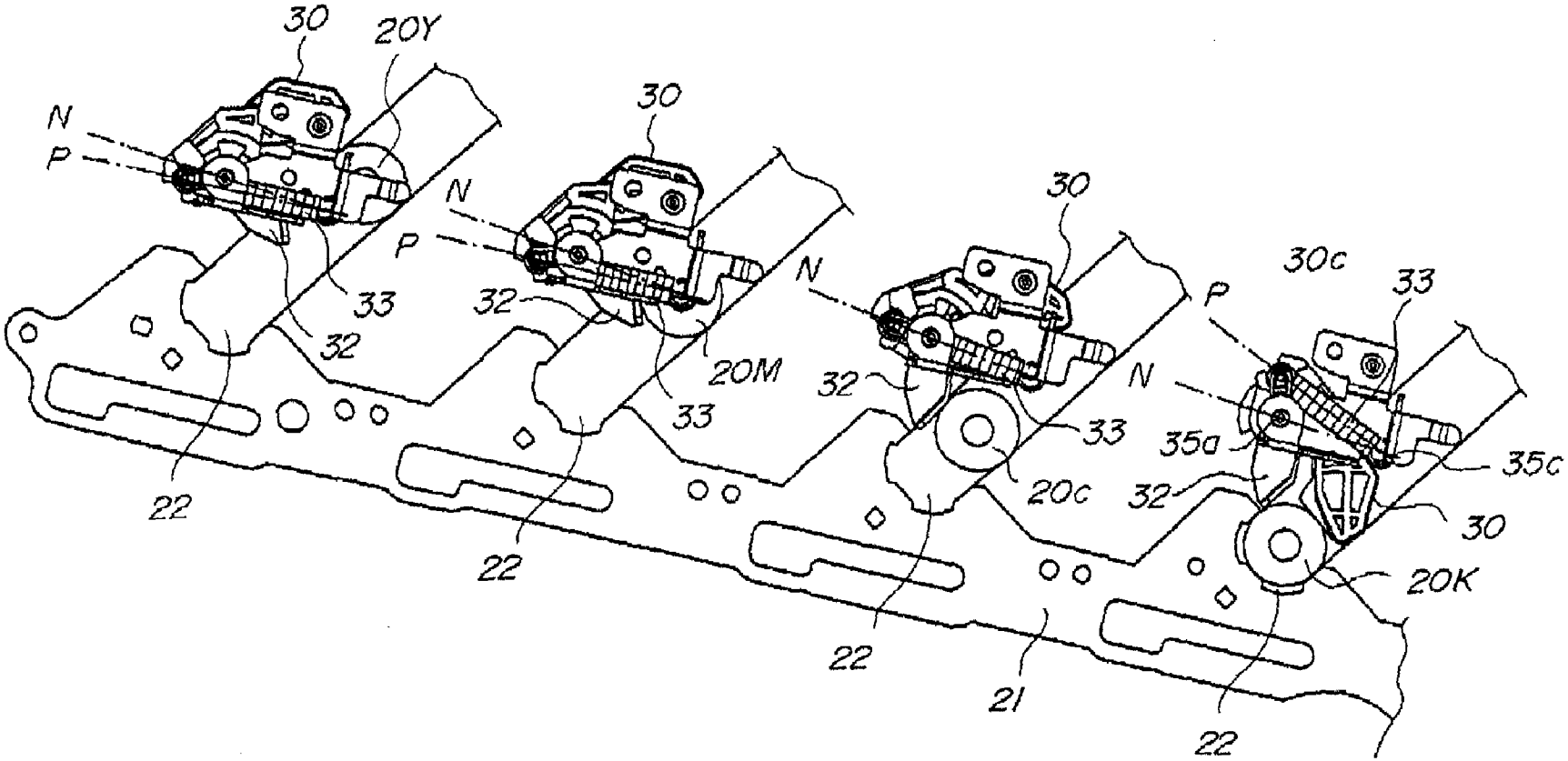
FIG. 3 is an explanatory diagram showing a latch motion of the toggle.

The operation when the cartridge 2 is attached to the attaching section on which the locking means is provided will be described with reference to FIGS. 2 and 3. FIG. 2 is an explanatory diagram showing a position of the cartridge projection 20 and operations of the input lever 32 and the toggle arm 30. FIG. 3 is an explanatory diagram showing a latch motion of the toggle arm 30 when the cartridge is to be attached.

First, a user opens the upper door unit 17 (see FIG. 4) over the apparatus main body, and exposes an attaching position of the cartridge 2 comprising the pair of left and right side plates 21 to an operator. The upper door unit 17 is designed such that the upper door unit 17 can be held at a position where it is opened in the upward direction of the apparatus main body at the maximum.

Next, the user slips a slanting surface provided on a bottom surface on the side of the cartridge along a guide slanting surface constituted on the guide member 23, and drops the cartridge into the apparatus main body. With this motion, the projection 20 of the cartridge moves into the U-groove 22. The projection 20 of the cartridge is the circular projection provided on the end of the image bearing member in the rotational axial direction of the image bearing member. If this projection abuts against an abutment portion of the U-groove provided in the side plate of the image forming apparatus, the image bearing member is positioned with respect to the image forming apparatus. That is, this projection functions for positioning the image forming unit with respect to the image forming apparatus.

In a process in which the projections 20 are engaged with the U-grooves 22, the projections 20Y, 20M, 20C and 20K move in this order as shown in FIGS. 2 and 3. This process will be described. When the cartridge is inserted, as shown with the projection 20Y, the projection 20 is guided along the U-groove having the guide section without being hindered by the toggle arm 30 located in the receded position. At that time, the input lever 32 is in the initial position. The input lever 32 projects from the moving path of this projection, and if the cartridge is inserted, it abuts against the input lever 32 as shown in the projection 20M, and the cartridge presses the input lever 32. With this, the input lever 32 starts rotating. However, the input lever 32 does not act on the toggle arm 30 until the input lever 32 rotates from the initial position by the certain angle which is the predetermined amount as described above.

Thus, even if the cartridge is inserted halfway by erroneous operation, the toggle arm 30 is not operated if the input lever 32 is returned until it rotates by the certain angle, and the input lever 32 is also returned to the initial position.

If the cartridge is further inserted, as shown in the projection 20C, the input lever 32 further rotates, and the retaining projection 32*d* is engaged with the projection 30*h* of the toggle arm 30, thereby transmitting the rotation force to the toggle arm 30. Then, as shown in FIG. 3, if the toggle spring 33 rotates beyond the neutral point, the toggle arm 30 rotates toward the locking position at a dash. Then, as shown in the projection 20K, the arm portion 30*b* presses the projection 20K toward the bottom of the U-groove 22 by a biasing force of the toggle spring 33. By this pressure, the projection 20K does not float from the U-groove 22 and is positioned and fixed.

When the cartridge 2 is inserted into a position where an image can be formed, even if the same main body and the same cartridge are used, a position with respect to the main body (housing) of the cartridge 2 is changed whenever the cartridge is inserted due to the tolerances of parts. On the contrary, the apparatus main body permits the tolerance and when the cartridge is in a certain range, an image is formed. That is, when the toggle arm 30 fixes the cartridge 2 to a position where an image can be formed, a certain tolerance is permitted for a phase when the toggle arm 30 is fixed.

When the cartridge 2 is taken out from the apparatus main body, if a user applies a force in a direction in which the cartridge is pulled out from the apparatus main body, the projection 20 of the cartridge 2 rotates the toggle arm 30. When the toggle arm 30 crosses over the neutral point, the toggle arm 30 moves from the locking position to the receded position, and the cartridge 2 can be taken out.

The above-described cartridge attaching operation is repeated by yellow, magenta, cyan and black stations. Then, a user closes the upper door unit 17 below the apparatus main body, and the transfer belt unit 9 is returned to the normal position of the apparatus main body.

In this embodiment, it is easy to attach the cartridge 2 to the apparatus main body, the appropriate operating feeling can be maintained, and it is possible to position and hold the cartridge 2 reliably when the attaching operation is completed. At the time of the attaching operation, an appropriate operating feeling can be maintained by a light rapping sound.

The compression spring 34 provided between the toggle arm 30 and the input lever 32 is set to a biasing force weaker than the toggle spring 33. Thus, it is possible to lighten an operating feeling other than when the toggle arm 30 is operated, which is necessitated because the cartridge locking means is used, and the part can be reduced in size due to the low pressure. Thus, a sense of discomfort with respect to existence of the toggle arm 30 when the cartridge is attached or detached can be eliminated together with the physical appearance and the operating feeling.

When viewing from the cartridge inserting direction, the toggle arm 30 is covered with the protection cover 31, but the input lever 32 can visually be seen. With this, the input lever 32 located in the initial position can easily be seen by the user, and when the cartridge is to be inserted, the input lever 32 can easily be seen like a position index. With this, it is not easily operated accidentally, and when the cartridge is to be attached, it becomes such an index that the cartridge can be guided by the input lever 32 laterally equally in the longitudinal direction. The cartridge projection 20 can be placed on the input lever 32. With this, a user can notice that it is in a position where the temporarily attaching preparation has been completed, and the attaching operating feeling can be enhanced.

In the explanation of the main body structure of the embodiment, the transfer belt unit 9 having the intermediate transfer body is mounted on the upper door unit 17. However, it is not always necessary that the upper door unit 17 has the transfer belt unit, and the transfer belt unit 9 and the upper door unit 17 may open and close independently, and the transfer belt unit 9 may be attached or detached alone after the upper door unit 17 is opened.

In the embodiment, the primary transfer surface formed by the opposed surfaces of the transfer belt unit 9 and the photosensitive drum 3 in the cartridge 2 form an inclining angle. However, it is not limited to this angle, and the optimal inclining angle can be selected if necessary by the height of the fixing device, the size of the exposing device 8 and the like, and the inclining angle may be eliminated, and it may be disposed horizontally.

Second Embodiment

Next, a structure of a cartridge locking means according to a second embodiment of the present invention will be described. The second embodiment is different from the first embodiment only in the structure of the locking means, and other structure is the same. Thus, only portions of the second embodiment which are different from those of the first embodiment will be described. The same members as those of the first embodiment will be designated with the same symbols.

{Structure of Locking Means}

Figure 7A:
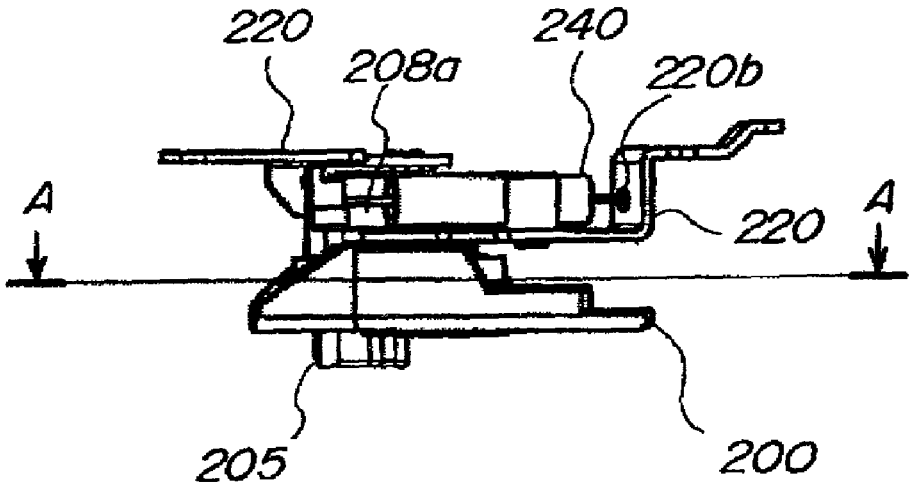
FIGS. 7A and 7B are explanatory fronts views when a pressure arm of the first embodiment is in an receded position.
Figure 7B:
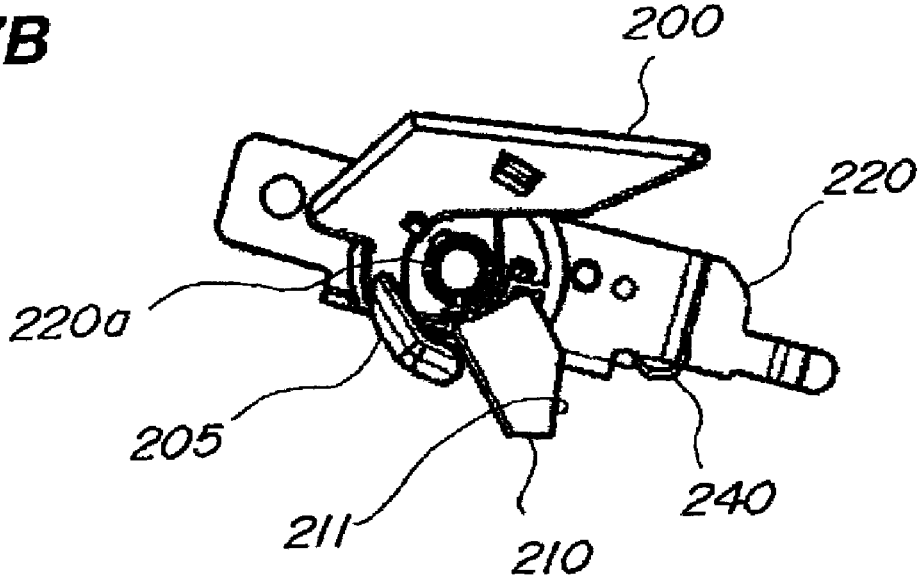
Figure 8:
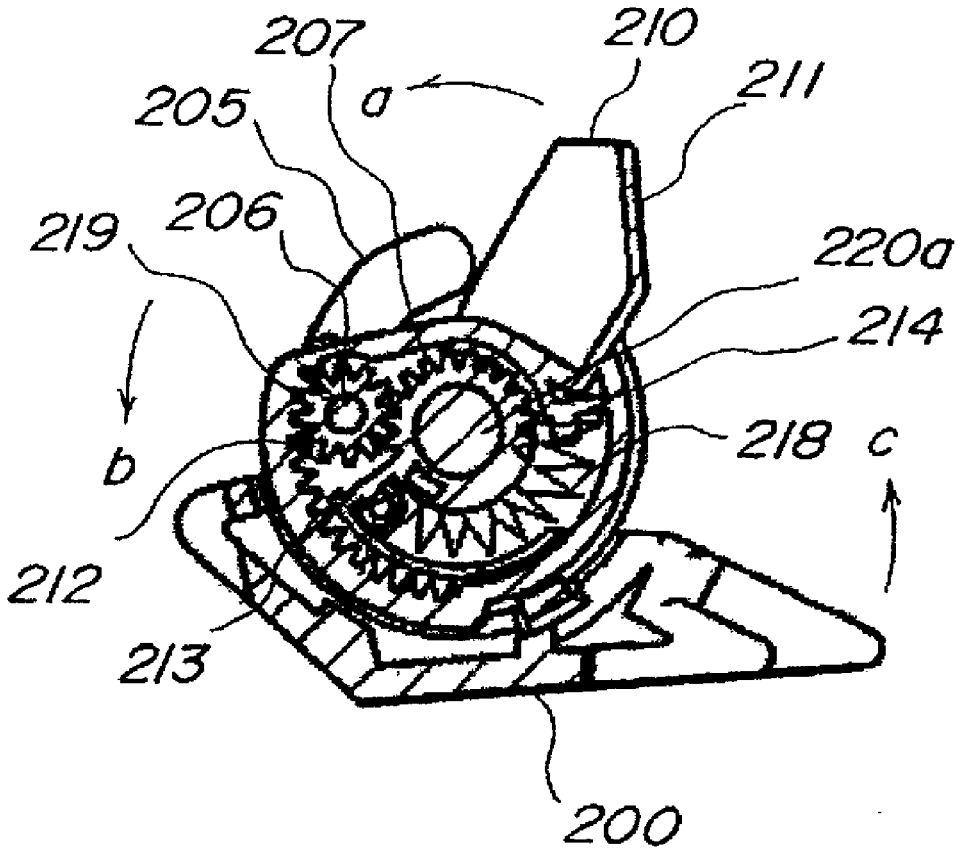
FIG. 8 is an explanatory sectional view taken along the line A-A in FIG. 7.
Figure 9A:
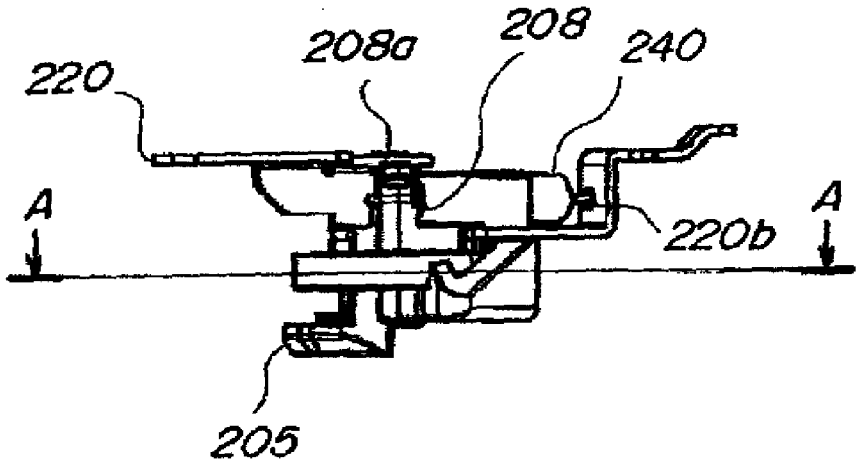
FIGS. 9A and 9B are explanatory front views when the pressure arm of the first embodiment is in a locking position.
Figure 9B:
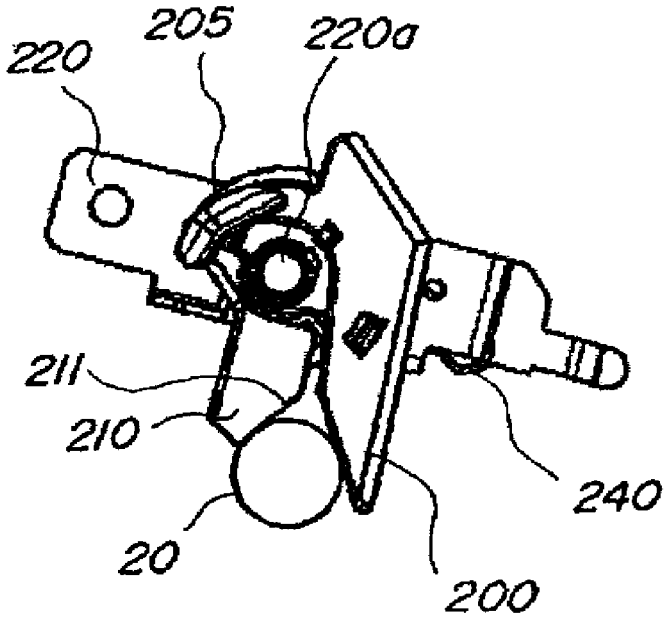
Figure 10:
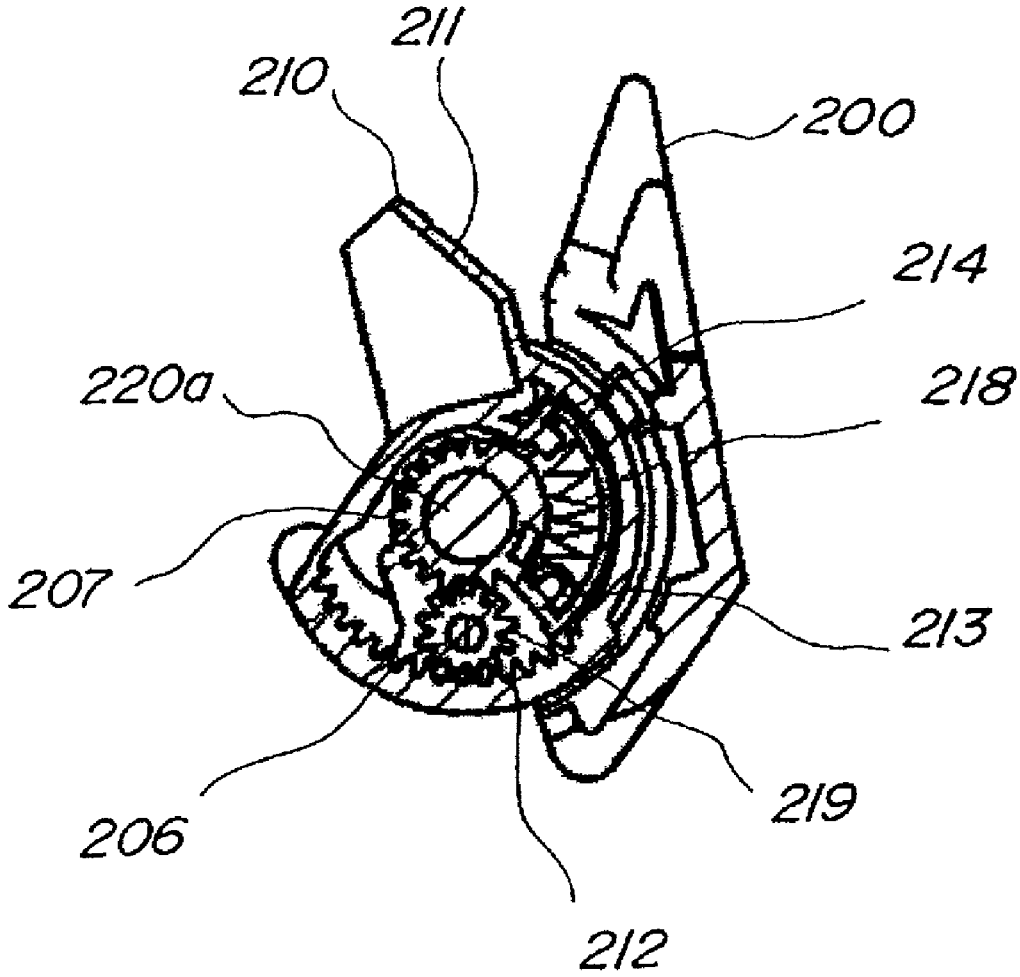
FIG. 10 is an explanatory sectional view taken along the line A-A in FIG. 9.

The structure of the locking means of the second embodiment will be described with reference to FIGS. 7 to 10. FIG. 7 is an explanatory front view and an explanatory top view when a pressure arm is in the receded position. FIG. 8 is an explanatory sectional view taken along the line A-A in FIG. 7. FIG. 9 is an explanatory front view and an explanatory top view when the pressure arm is in a locking position. FIG. 10 is an explanatory sectional view taken along the line A-A in FIG. 9.

The locking means of this embodiment also fixes a cartridge attached to the toggle latch mechanism. According to the locking means of the embodiment, a toggle member 208, which is driving force giving means, an input lever 210 as a moving member, and a pressure arm 200, which becomes a locking member, are turnably mounted on a shaft portion 220*a* of a mounting plate 220 such that they are superposed in this order, and they are held by the shaft portion 220*a*. The shaft portion 220*a* is fixed to the mounting plate 220 by swaging, and the mounting plate 220 is mounted on a side plate 21 by a screw or the like.

A toggle spring 240 comprising an extension spring which becomes biasing means is provided between a spring retaining projection 208*a* of a toggle member 208 and a spring retaining portion 220*b* of a mounting plate 220 so that a biasing force is applied to the toggle member 208. A position of the spring retaining projection 208*a* is moved to either one of the sides with respect to a neutral point of a turning range by the toggle latch mechanism described in the first embodiment and with this, one side and the other side are switched over. When the toggle member 208 is switched between the one side and the other side, the pressure arm 200 is also moved and biased to the receded position or the locking position in association with the toggle member 208.

In the locking means of the embodiment, an engaging section 205 acts in addition to the input lever 210 as an acting member for operating the toggle member 208. The engaging section 205 is a projection which is integrally formed together with the pressure arm 200, and is disposed in a position where the engaging section 205 is pressed by a drum shutter which is opened and closed in association with attaching and detaching motion of the cartridge 2.

Figure 11C:
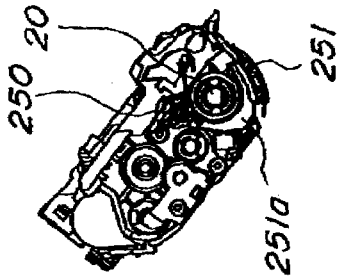
FIGS. 11A to 11C are explanatory diagrams of a projection of a cartridge and a shutter arm.
Figure 11B:
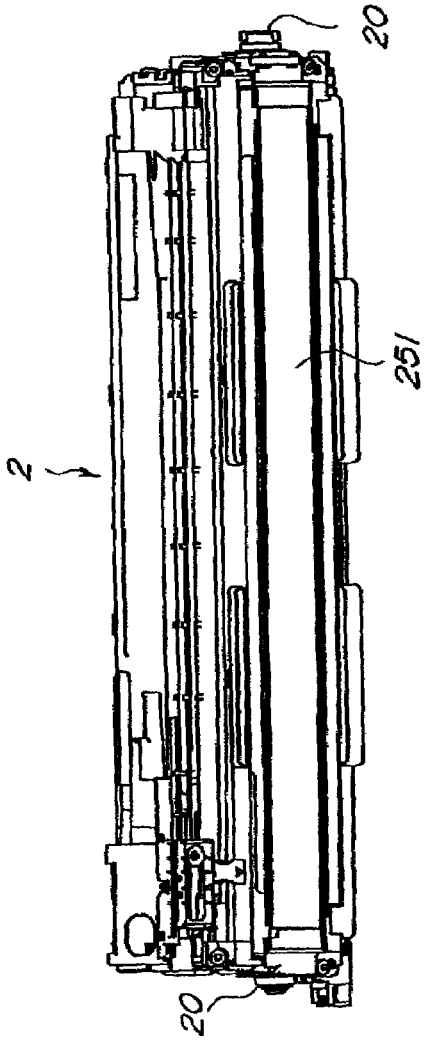
Figure 11A:
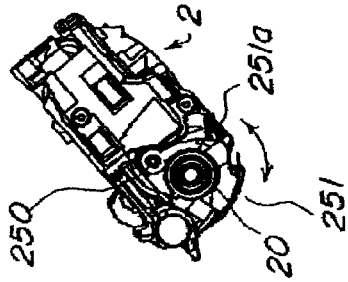

It is necessary that the photosensitive drum 3 provided in the cartridge 2 comes into contact with the transfer belt unit 9 when the cartridge 2 is attached to the apparatus main body. Thus, the photosensitive drum 3 needs to be exposed. However, if the photosensitive drum 3 is exposed in a state where the cartridge 2 is taken out from the apparatus main body, a photosensitive layer is easily deteriorated and there is an adverse possibility that the photosensitive drum 3 is damaged accidentally. Thus, in general, the cartridge is provided with a shutter member capable of opening and closing an opening from which the photosensitive drum 3 is exposed, the shutter member is opened in association when the cartridge is attached to the apparatus main body, and when the cartridge is taken out, the shutter member is closed. In the cartridge 2 of the embodiment also, as shown in FIG. 11, a shutter rotation shaft 250, which is a turning center of the shutter member, is provided near the projections 20 which project on both sides on an extension of the rotation shaft of the photosensitive drum 3. Both sides of a drum shutter 251 in its longitudinal direction are supported by a shutter arm 251*a*, which can turn around the shutter rotation shaft 250. The drum shutter 251 is opened and closed in association when the cartridge 2 is attached to or detached from the apparatus main body. A known mechanism may be used for opening and closing the drum shutter 251.

When the drum shutter 251 is opened, the shutter arm 251*a* presses the engaging section 205, which is integrally formed together with the pressure arm 200. According to the locking means of the embodiment, the toggle latch mechanism is operated by rotation caused when the input lever is pushed by the cartridge projection 20 and by rotation caused when the engaging section 205 is pushed by the shutter arm 251*a*.

Here, a structure for operating a latch mechanism of the embodiment when the cartridge is inserted will be described.

A positional relation between the pressure arm 200, which is a locking member, and the input lever 210, which is a moving member, is shown in FIGS. 7 and 8, which shows a state where the cartridge is not attached to the cartridge attaching section, i.e., a state where the pressure arm 200 is in the receded position. At that time, the projection guide surface 211 of the input lever 210 is disposed such that it projects toward a path in an attaching direction of the cartridge, comes into contact with the cartridge projection 20 which is inserted, and turns the cartridge projection 20.

The engaging section 205 which is integrally formed together with the pressure arm 200 is located in a moving region of the shutter arm 251*a* when the cartridge 2 is inserted along the guide member 23.

As shown in FIG. 8, an inner gear (gear portion) 207 is integrally provided on a turning center of the pressure arm 200. A toggle pinion gear 219 mounted on a shaft 206, which is integrally provided on the toggle member 208, is meshed with the inner gear 207. The pinion gear 219 can turn like a planet gear around the inner gear 207. The shaft 206 of the pinion gear 219 is coaxial with the spring retaining projection 208*a* to which the toggle spring 240 is retained. Thus, the toggle latch mechanism is operated depending upon which one of the sides with respect to the neutral point of the toggle member 208, a moving position of the pinion gear 219 is located.

The pinion gear 219 is also meshed with an outer gear (gear portion) 212, which is formed on the input lever 210. The pinion gear 219 is meshed with both the inner gear 207 and outer gear 212, which are coaxial with each other and which can rotate, and the gears 207 and 212 can independently rotate. Thus, pinion gear 219 is moved by a mechanical mechanism based on a so-called differential principle.

That is, if the input lever 210, which is integral with the outer gear 212. is rotated in the direction of the arrow a in a state where the pressure arm 200, which is integral with the inner gear 207 is stopped, since the pinion gear 219 rotates in the counterclockwise direction, the pinion gear 219 moves in the direction of the arrow b along the inner gear 207. If the pressure arm 200 rotates in the direction of the arrow c in a state where the input lever 210 is stopped, the pinion gear 219 rotates in the clockwise direction and moves in the direction of the arrow b along the outer gear 212.

In this embodiment, a gear ratio is set such that a moving amount of the pinion gear 219 (the rotation amount around the shaft portion 220*a*) with respect to rotation amounts of the input lever 210 and the pressure arm 200 becomes ½.

By pressing the input lever 210 and the engaging section 205, the input lever 210 and the pressure arm 200 are independently rotated, and the pinion gear 219 is moved. With this, the toggle latch is operated by moving the spring retaining projection 208*a* of the toggle spring to either one of sides with respect to the neutral point. In this embodiment, when the toggle member 208 moves to the locking position by the operation of the toggle latch, the toggle member 208 and the pressure arm 200, which is retained by the retaining portion (not shown), also integrally move to the locking position.

FIGS. 9 and 10 show a state where the toggle member 208 goes beyond the neutral point, and the pressure arm 200 moves to the locking position together with the toggle member 208.

A compression spring 218, which is shown in FIGS. 8 and 10, applies a force to the input lever 210. One end of the compression spring 218 is provided on a spring seat surface 214 provided on the input lever 210, and the other end is fitted to a boss provided on a seat surface 213 provided on the pressure arm 200. Like the first embodiment, a biasing force of the compression spring 218 is set smaller than that of the toggle spring 240.

{Attaching Operation of Cartridge and Operation of Locking Means}

Figure 12:
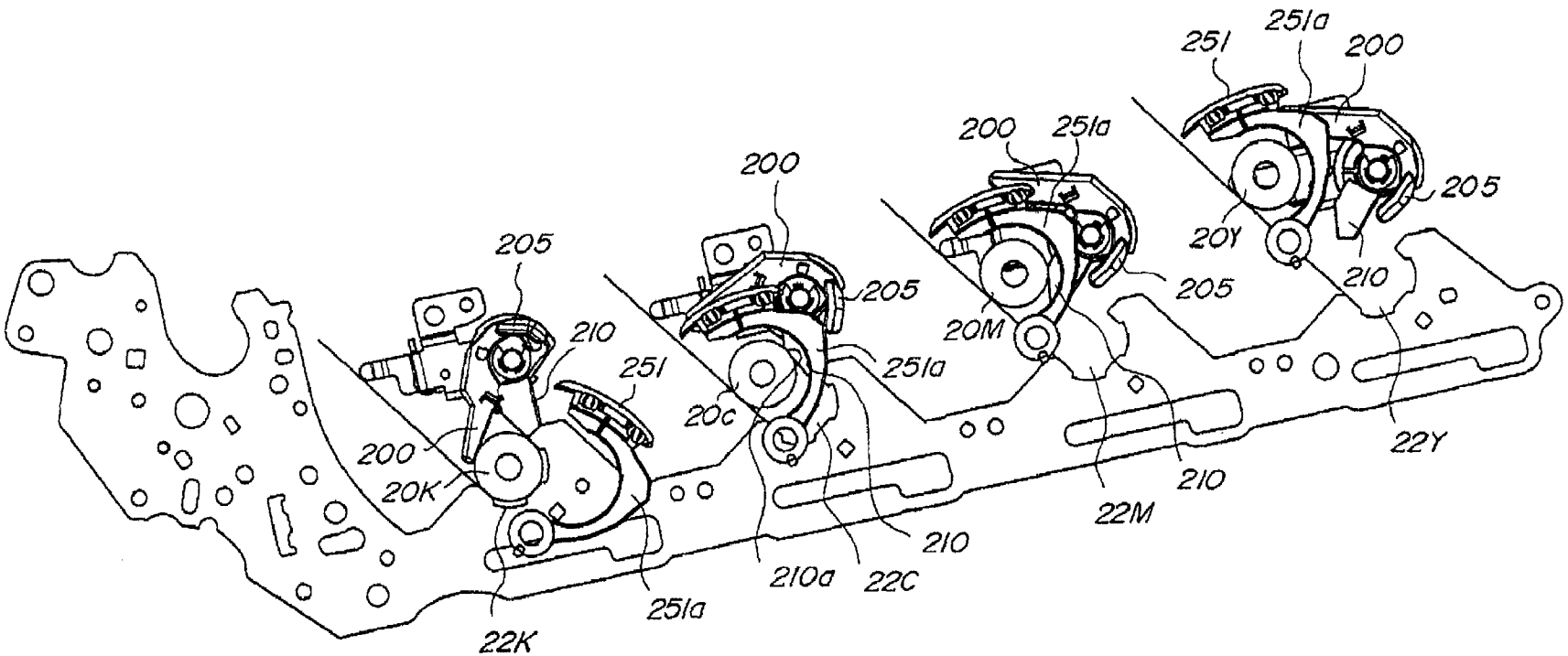
FIG. 12 is an explanatory diagram showing positions of the cartridge projection and the shutter arm, and motion of an input lever, an engaging section and a pressure arm when a cartridge according to a second embodiment is attached.

Next, the operation when the cartridge 2 is attached to the attaching section where the locking means is provided will be described with reference to FIG. 12. FIG. 12 is an explanatory diagram showing positions of the cartridge projection 20 and the shutter arm 251*a*, and the operation of the input lever 210, the engaging section 205 and the pressure arm 200 when the cartridge of the second embodiment is to be attached.

Like the first embodiment, a user slips the slanting surface of the cartridge provided on the bottom surface on the side of the cartridge along the guide slanting surface constituted on the guide member 23, and drops the cartridge into the apparatus main body. With this operation, the projection 20 of the cartridge moves into the U-groove 22.

In a process in which the projections 20 are engaged with the U-grooves 22, the projections 20Y, 20M, 20C and 20K move in this order as shown in FIG. 12. This process will be described. When the cartridge is inserted, as shown with the projection 20Y, the projection is guided in the U-groove 22 without being hindered by the toggle arm 200 located in the receded position. The input lever 210 projects from the moving path of the projection, and if the cartridge is inserted, it abuts against the input lever 210 as shown in the projection 20M, and the lever 210 is pushed. With this, the input lever 210 rotates in the counterclockwise direction in FIG. 12. At that time, since the shutter arm 251*a* has not yet reached the pressure arm 200, the pressure arm 200 is prevented from rotating. Thus, the pinion gear 219 moves by ½ amount of the rotation amount of the input lever 210 by the differential mechanism, and the position of the retaining projection 208*a* of the toggle spring 240 moves.

At this time, the toggle member 208 does not go beyond the neutral point. Thus, the toggle mechanism is not switched only by turning the input lever 210, and the pressure arm 200 is not locked. At this moment, if the cartridge is returned, the input lever 210 is biased by the compression spring 218 and returned to the initial position.

If the cartridge is further inserted, as shown in the projection 20C, an angle of the abutment portion of the projection of the input lever 210 becomes parallel to the inserting direction of the projection, and the input lever 210 does not further rotate. As the cartridge is inserted, the shutter arm 251*a* abuts against the engaging section 205 and presses the same. With this, the pressure arm 200 which is integral with the engaging section 205 rotates in the counterclockwise direction in FIG. 12. At that time, the input lever 210 is prevented from rotating as described above. Thus, the pinion gear 219 moves by an amount of ½ of the rotation amount of the pressure arm 200, and the position of the retaining projection 208*a* of the toggle spring 240 is moved.

A moving position of the turning shaft 206 is determined by a sum of the turning and moving angle of the input lever 210 and a moving angle of the engaging section 205, this position moves beyond the neutral point and the toggle mechanism is operated, the pressure arm 200 is moved to the locking position, presses and fixes the projection 20K.

In this embodiment also, the cartridge is inserted halfway, and the toggle member 208 is not operated only by rotating the input lever 210. If the cartridge is retuned at a position before the toggle member 208 goes beyond the neutral point, the toggle member 208 is returned by the toggle spring 240 and is returned to the initial position. Thus, it is possible to prevent the pressure arm 200 from being locked by erroneous operation.

Figure 13A:
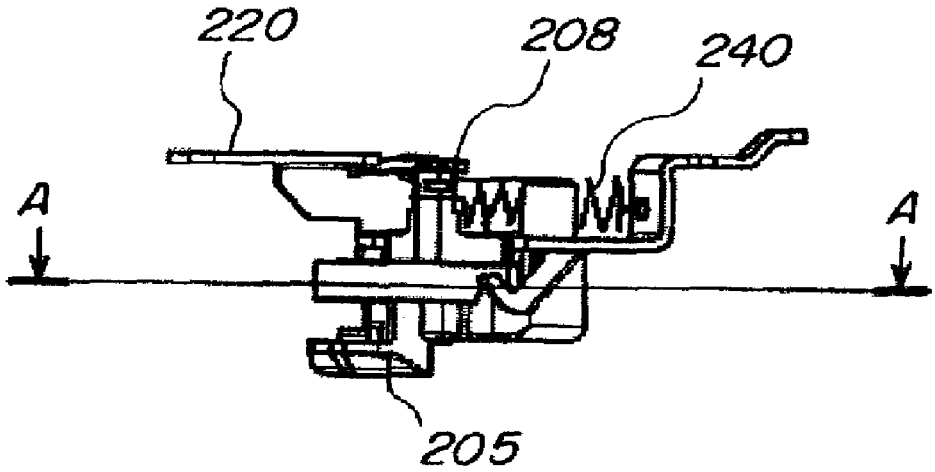
FIGS. 13A and 13B are a front view and a plan view of an over position of locking means, respectively.
Figure 13B:
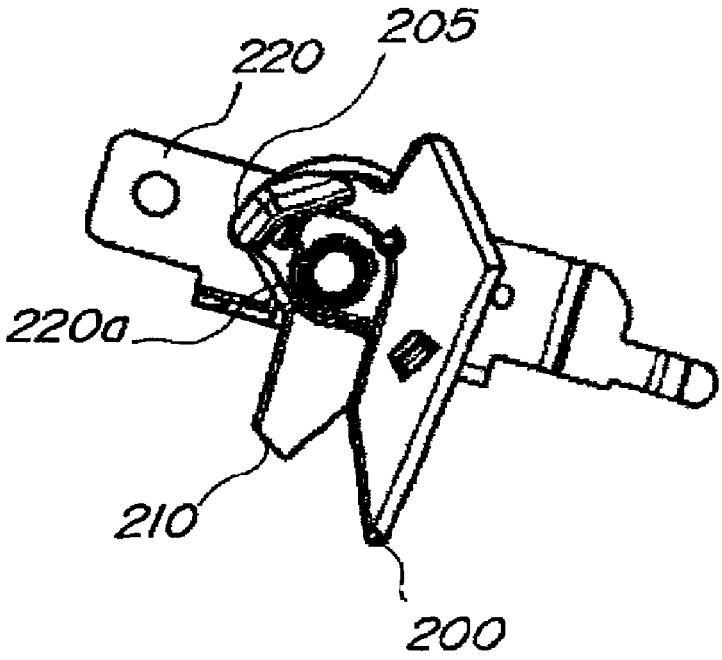
Figure 14:
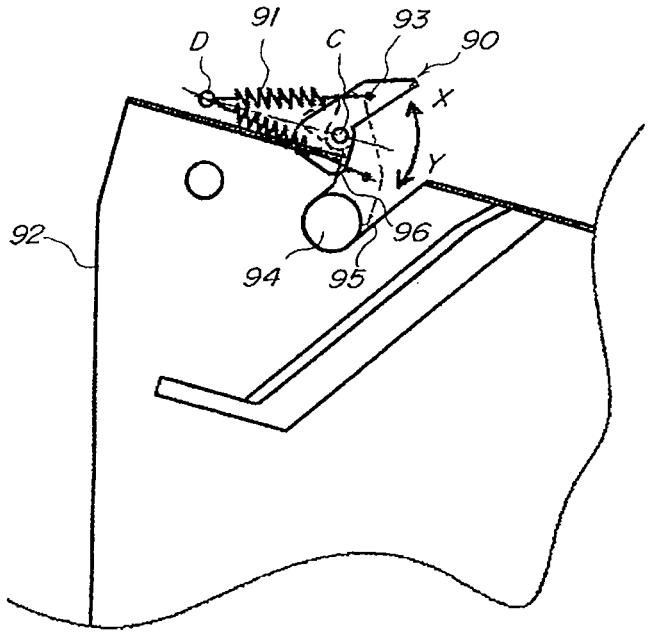
FIG. 14 is an explanatory of a conventional technique.

In order to obtain a biasing force for positioning the cartridge projection 20 at the U-groove 22 while pressing the cartridge projection 20 by the pressure arm 200, as show in FIG. 13, the input lever 210 and the pressure arm 200 can further turn and approach each other than the state shown in FIG. 9. In an actual using state, it does not reach the overrun position but it is preferable that it can turn to such a position if a size tolerance is taken into account with respect to FIG. 9.

An abutment angle between the input lever 210 and a cartridge of the pressure arm 200 is about 90°. With this, a position of the input lever 210 can easily be visually checked in a narrow space, the input lever 210 located in the initial position can easily be seen from a user, and when the cartridge is to be inserted, the input lever 210 can easily be seen like a position index. With this, it is not easily operated accidentally, and when the cartridge is to be attached, it becomes such an index that the cartridge can be guided by the input lever 210 laterally equally in the longitudinal direction. The cartridge projection 20 can be placed on the input lever 210. With this, a user can notice that it is in a position where the temporarily attaching preparation has been completed, and the attaching operating feeling can be enhanced.

Next, when the cartridge, which is attached to the apparatus main body, is taken out, if the attached cartridge is pulled out, the cartridge projection 20 moves and the pressure arm 200 moves to the receded position as shown in FIG. 8. The input lever 210 and the arm portion 200*a* of the pressure arm 200 are opened by repulsion of the compression spring 218. When the cartridge is pulled out, the pressure arm 200 is pushed back and thus, the toggle pinion gear 219 retreats beyond the neutral point and is returned to its initial position.

As described above, according to the present invention, it is possible to reduce a load when the image forming unit is inserted, and to prevent the fixing member from operating accidentally even if a pressing force to the image forming unit of the fixing member is not reduced when the image forming unit is attached.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-301455, filed Nov. 7, 2006, which is hereby incorporated by reference herein in its entirety.

What is claimed is:

1. An image forming apparatus comprising:

an image forming unit which has an image bearing member and which is detachably attachable to the image forming apparatus;

a guide section that guides an insertion operation of the image forming unit;

a movable locking member that locks the attached image forming unit;

a moving member which starts to move when the moving member comes into contact with the image forming unit which is inserted along the guide section; and a locking member moving mechanism which does not move the movable locking member until the moving member moves by a predetermined distance, and starts to move the movable locking member after the moving member moves by the predetermined distance.

2. The image forming apparatus according to claim 1, wherein the locking member moving mechanism has a first contacting portion and a second contacting portion, wherein the first contacting portion and the second contacting portion maintain a non-contacting status until the moving member moves by the predetermined distance, and wherein the first contacting portion and second contacting portion contact each other and start to move the movable locking member when the moving member moves by the predetermined distance.

3. The image forming apparatus according to claim 1, further comprising a shaft, wherein the movable locking member and the moving member are supported by the shaft.

4. The image forming apparatus according to claim 3, wherein the movable locking member and the moving member are rotatable around the shaft, and when the moving member rotates by a predetermined amount, a moving force for the movable locking member is transferred from the moving member to the movable locking member by contact of a first contacting portion and a second contacting portion of the locking member moving mechanism.

5. The image forming apparatus according to claim 4, wherein the image bearing member is rotatable, and a positioning section for positioning the image bearing member with respect to the image forming apparatus is provided on an end of the image bearing member in a direction of a rotation axis of the image bearing member.

6. The image forming apparatus according to claim 5, wherein said image forming apparatus includes a positioned portion which abuts against said positioning section, and said movable locking member presses toward said positioned portion so that an abutment state between said positioning section and said positioned portion is maintained.

7. The image forming apparatus according to claim 6, wherein said positioned portion is a U-groove.

8. The image forming apparatus according to claim 7, wherein the guide section guides the image bearing member toward the U-groove.

9. An image forming apparatus according to claim 1, wherein an opening and closing member is provided at an upper surface of said image forming apparatus in a vertical direction of said image forming apparatus, and said image forming unit is insertable into said image forming apparatus through an opening which is formed by opening said opening and closing member.

10. The image forming apparatus according to claim 1, further comprising driving force providing means for providing a driving force to said movable locking member and disposed in the image forming unit, wherein the movable locking member starts moving to a locking position by a driving force caused by operation of said moving member and a driving force from said driving force providing means, after the moving member moves by the predetermined distance.

11. The image forming apparatus according to claim 10, wherein the driving force providing means is a covering member that covers the image bearing member and the driving force providing means moves from a position for covering the image bearing member to a position for exposing the image bearing member according to an insertion operation of the image bearing member by the guide section.

12. The image forming apparatus according to claim 10, wherein the movable locking member has a driving force receiving means which receives the driving force from the driving force providing means.

13. The image forming apparatus according to claim 11, wherein when the image forming unit is mounted on the image forming apparatus, the covering member moves to a position where the covering member exposes the image bearing member.

* * * * *